US006374633B1

(12) United States Patent
Greer et al.

(10) Patent No.: US 6,374,633 B1
(45) Date of Patent: Apr. 23, 2002

(54) PELLETIZING SYSTEM

(75) Inventors: Brian Greer, Monroe; James L. Tharp, Jr., Duluth, both of GA (US)

(73) Assignee: Tomco2 Equipment Co., Loganville, GA (US)

( * ) Notice: Subject to any disclaimer, the term of this patent is extended or adjusted under 35 U.S.C. 154(b) by 0 days.

(21) Appl. No.: 09/693,050

(22) Filed: Oct. 20, 2000

(51) Int. Cl.[7] ..... F25J 1/00
(52) U.S. Cl. ..... 62/605
(58) Field of Search ..... 62/384, 387, 604, 62/605

(56) References Cited

U.S. PATENT DOCUMENTS

| | | | | | |
|---|---|---|---|---|---|
| 5,385,023 | A | * | 1/1995 | Montemayor et al. | 62/10 |
| 5,528,907 | A | | 6/1996 | Pint et al. | |
| 5,548,960 | A | | 8/1996 | Anderson et al. | |
| 5,765,394 | A | * | 6/1998 | Rhoades | 62/603 |
| 5,845,516 | A | * | 12/1998 | Allen, Jr. | 62/605 |
| 6,189,336 | B1 | * | 2/2001 | Wade, Jr. | 62/604 |
| 6,244,069 | B1 | * | 6/2001 | Hyde, Jr. et al. | 62/604 |

* cited by examiner

*Primary Examiner*—William Doerrler
*Assistant Examiner*—Malik N. Drake

(74) *Attorney, Agent, or Firm*—Todd Deveau; Ryan A. Schneider; Troutman Sanders LLP

(57) ABSTRACT

The present invention is an improved dry ice pellet manufacturing system including an automated helical injection system, a chamber having a greater filter screen ratio than prior art designs and a compressing mechanism. The automated helical injection system enables injected $CO_2$ to follow an approximately helical path inside the extrusion chamber, such that $CO_2$ snow begins to form, and is packed, at the die end of the chamber. The automated injection subsystem provides maximum ice production, the present system utilizes both staggered injection rates and a valve arrangement that improve (increases) upon the amount of $CO_2$ injected into the extrusion chamber over time. The present invention further utilizes a chamber having a greater filter screen ratio than currently is used in the art. The extrusion chamber of the improved pelletizer of the present invention has approximately a 35% or greater filter screen ratio; filter screen ratio being defined as the ratio of filter screen area to chamber bore area. The compressing mechanism of the present invention includes a rod and piston assembly capable of travel within the chamber. The rod can be made of steel, and the piston, a sleeve retainer and sleeve can be made of UHMW polyethylene, TEFLON, DELRIN, oil filled NYLON, NYLON, or any other tough, low-friction, non-stick, non-abrasive, food-grade material.

23 Claims, 7 Drawing Sheets

PELLETIZING SYSTEM

BACKGROUND OF THE INVENTION

1. Field of the Invention

This invention relates generally to the field of dry ice manufacturing, and more particularly to a method and apparatus for producing pellets of dry ice.

2. Description of Related Art

Dry ice is the solid state of carbon dioxide ($CO_2$). There are a vast array of applications for dry ice, including the processing and preservation of meats and other foods. Dry ice is the preferred means of cooling in such applications, since it imparts no color, odor, or taste, and has no lingering deleterious effect on the food. Dry ice also is desirable for the processing of food because its sublimes directly from the solid state to the gaseous phase, leaving no residue behind after yielding its cooling effect; therefore, no clean-up or removal of residual liquid is required. Furthermore, $CO_2$ is neither toxic, poisonous, reactive with other chemicals, nor flammable.

In its solid state, at standard temperature and pressure, carbon dioxide has a constant and stable temperature of −109.33° F. Carbon dioxide is normally transported in its liquid state, and stored in refrigerated vessels at a pressure of about 300 psia, and a corresponding temperature of about 0° F.

Once the liquid $CO_2$ reaches the manufacturing facility, dry ice is generally formed into one of the two final forms, blocks of dry ice or smaller pellets. Large blocks of dry ice typically are shipped long distances or stored for extended periods, as pellet size pieces sublimate faster.

The basic process for making dry ice blocks from liquid carbon dioxide has long been known. Sometimes, these blocks of dry ice from a block press are reduced to a smaller size that can more easily be handled and used in many types of applications. Other machines, for example the dry ice pelletizer, produces dry ice pellets. Dry ice pellets are easily packaged by the manufacturer and subdivided by the consumer into convenient portions for use. These dry ice pellets find a vast array of applications, including applications in the processing and preservation of meats and other foods because of the thermal, physical, and chemical properties of dry ice. In certain applications, the dry ice pellets come in intimate contact with the food being processed, such as in a meat packing house and in certain seafood processing plants. The dry ice pellets in these applications are delivered directly onto the food being processed to rapidly cool the food and to keep the food below a specified maximum temperature to prevent spoilage while processing and prior to refrigerated storage. Also, dry ice has long been the favored refrigerant for ice cream vendors and distributors.

Conventional dry ice pellet manufacturing processes incorporate several disadvantages and limitations. Prior art arrangements of the injection system and chamber typically dictate the use of only low $CO_2$ flow rates; thus, limiting pellet production. It would be beneficial to provide a pelletizing system that can handle increased flow rates in order to maximize pellet production.

One limitation of known pelletizers, for example, is the angle at which the liquid $CO_2$ is injected into the extrusion chamber. Conventional injection is generally perpendicular to the length (radial centerline) of the extrusion chamber. Such generally perpendicular injection is representatively shown in FIG. 1 of U.S. Pat. No. 5,528,907. Alternatively, an injection path that is generally parallel to the length (radial centerline) of the extrusion chamber has been used. Such generally parallel injection is representatively shown in FIG. 5 of U.S. Pat. No. 5,548,960. Both perpendicular and parallel injection suffer from limited flow stream interaction with the inner wall(s) of the chamber, improper snow piling and clogging problems.

For example, under the generally perpendicular injection conditions, approximately equal amounts (being one-half the total amount) of the injected $CO_2$ flow toward each end of a the chamber after the flow strikes the inside of the chamber. The $CO_2$ enters through the injection port, travels through the core of the chamber and collides into the inner wall of the other side of the chamber approximately normal to the inner wall. The flow then splits into two, opposite directional streams, each flowing toward an end of the chamber. It is problematic that $CO_2$ snow begins to pile up at the collision site, and the pile then grows in length toward either end of the chamber. As snow begins to pile up between the collision site and the vent port, any escaping gaseous $CO_2$ must first travel through this snow pile before it can be released from within the chamber through the vent port. This injection arrangement impedes maximum snow production because pressure builds up in the chamber prematurely as the volume of the chamber ever shrinks from both sides of the injection point due to piled snow, and because pressure does not have an unencumbered path to exit the chamber, but must pass through forming snow. This type of injection also can prematurely clog the exhaust vent(s) of the extrusion chamber with solid $CO_2$, which clogging limits production. This orientation of injection also inefficiently cools the chamber at start-up, delaying the formation of the ice plug, as the injected $CO_2$ cools the chamber from the point of collision out toward the ends. Therefore, the die end of the chamber, the point at which the plug will form, is cooled last.

Another limitation of known pelletizers is the use of only a single injection port that also hampers attempts at increasing injection flow rates into the chamber. Additionally, the geometry of standard injection nozzles is inefficient. The current use of straight, or nontapered, pipe designs of nozzles frequently leads to blockages of the nozzle, completely stopping production. Not only can the non-tapered design clog, but another adverse effect of such a non-tapered pipe is the resultant random pressure variations inside the extrusion chamber. These variations can lead to frequent operator (manual) adjustment of the metering valve.

Further, there is a lack of automation with present pelletizers. An improvement over the conventional injection system and extrusion chamber would be the provision of automated control over the injection of liquid $CO_2$ into the chamber. Current designs have a manually adjustable metering valve that constantly must be adjusted to compensate for numerous operational variables including clogging of the injection port and changes in liquid pressure. Certain high volume dry ice production facilities have many machines producing tons of ice per day. Each one of these machines has at least one of these metering valves and each one of these valves must be adjusted several times per day. Labor cost to monitor and adjust these metering valves is very high. Replacing the manually operated metering valves with automated control process valves would significantly reduce the labor necessary to operate a pelletizer.

Other disadvantages of the conventional dry ice pellet manufacturing processes lie outside the injection system and extrusion chamber of pelletizers. For example, current pelletizing machines do not incorporate an automated start-up procedure. Yet, if injection is orientated for increased production (as the present invention provides), the production of a dry ice plug without manual, time consuming intervention becomes impractical. On machines with six inch bores and larger, the machine on its own may never build a plug. If fact, starting a machine in this manner is very wasteful and dangerous. An automated start-up system would allow the operator to begin the pelletizer run, and not intervene again.

The filter area of present pelletizers is yet another feature in the production of dry ice upon which improvements can be made. Conventional pelletizers have a ratio of filter screen area to chamber bore area that defeats efficient pellet production. As this ratio drops, so too does the production of dry ice. It would be beneficial to provide a pelletizer having a higher ratio of filter screen area to chamber bore area than do conventional pelletizers.

Further, the current piston assemblies of pelletizers are disadvantageous and need improvement to generate better production efficiencies.

Therefore it can be seen that there is a need in the art for an improved dry ice pelletizing system that overcomes these and other prior art deficiencies. It is a provision to such an improved pelletizer that the present invention is primarily directed.

BRIEF SUMMARY OF THE INVENTION

Briefly described, in a preferred form, the present invention is an improved dry ice pellet manufacturing system including an automated helical injection system, an automated start-up system, a chamber having a greater filter screen ratio than prior art designs and a compressing mechanism. The present invention builds upon known pelletizing systems commonly comprising an extrusion chamber having an injection port through which liquid $CO_2$ is introduced into the chamber. In the chamber, the liquid $CO_2$ turns to portions of both gaseous and solid $CO_2$. A piston compresses the $CO_2$ snow in the chamber, and the gaseous $CO_2$ is vented from the chamber through a venting port. The resulting mass of dry ice is then pushed through an extrusion die to produce dry ice pellets.

The automated helical injection system of the present invention comprises compound angle injection, tapered injection nozzles and an automated injection subsystem. Whereas conventional injection nozzles are situated generally perpendicular or parallel to the radial centerline of the extrusion chamber, the present system utilizes compound angle injection into the chamber. Compound angle injection provides the injected $CO_2$ stream with at least an approximately helical flow path within the chamber, the path winding its way to the die end of the chamber. In this way, $CO_2$ snow begins to pile, and is packed, at the die end of the chamber. Thus, there is little or no snow piled between the injection site and the vent port, so pressure can be immediately released. The shortest path between two points on a cylinder (one not directly above the other) is a fractional turn of a helix. An exemplary use of compound angle injection utilizes compound angle nozzles.

Another improvement provided by the present pelletizing system is the use of tapered injection nozzles, wherein the bore of each nozzle diverges in the direction from the metering valve to the extrusion chamber. A diverging injection nozzle as described accelerates the snow through the nozzle, enabling it to pack tighter, squeeze out vapor, and limit clogging.

The present pelletizing system further incorporates a beneficial automated injection subsystem. The automated injection subsystem includes at least two injection ports for injection of liquid $CO_2$ into the chamber, staggered injection rate capability and a valve arrangement.

In order to provide maximum ice production, the present system utilizes both staggered injection rates and a valve arrangement that improve (increases) upon the amount of $CO_2$ injected into the extrusion chamber over time. The automated injection subsystem is similar to the flow of gasoline into a car's gas tank. At the fill station, an individual places the gas nozzle into the gas pipe, and enables the maximum flow of gas into the tank by pulling the hand lever as hard as possible. When the nozzle senses a preset pressure, the lever is disengaged, and the individual can top off the tank, but only at a reduced flow rate.

The present system utilizes at least two injection flows, a first injection flow that is a maximized flow until a preset pressure within the chamber is reached wherein that injection flow is closed, and a second injection flow of diminished flow rate capable of "topping off" the chamber after the first injection flow is halted.

The valve arrangement provides valves that are adjustable to various flow rates. As the pressure in the chamber increases, the valves are closed in order from highest flow rate to lowest. This arrangement enables the pressure inside of the extrusion chamber to remain at approximately the highest possible pressure below the triple point for most of the injection cycle. These controlled process valves enable the automated injection of liquid $CO_2$. The controlled process valves eliminate the conventional manual labor necessary to adjust the manually operated metering valves of known machines by automating this procedure.

The automated start-up system of the present invention comprises a start-up injection valve that is used to fill the chamber with pressure without blowing snow out of the chamber. The automated start-up system enables the development of an ice plug in the chamber. The compound angle of the start-up injection flow enables the die end of the chamber to cool as fast as possible, as the flow stream is not split, and guided to the die end.

The present invention further utilizes a chamber having a greater filter screen ratio than currently is used in the art. The extrusion chamber of the improved pelletizer of the present invention has approximately a 35% or greater filter screen ratio; filter screen ratio being defined as the ratio of filter screen area to chamber bore area. The chamber can include filter media placed over one or more of the venting ports in order to maximize the vapor exhaust rate of $CO_2$ from the chamber. Filters over the venting ports allow such a rapid exhaust rate without traditional concerns including the loss of snow into the exhaust piping.

The compressing mechanism of the present invention comprises a rod and piston assembly capable of travel within the chamber. The rod can be made of steel, and the piston, a sleeve retainer and sleeve can be made of UHMW polyethylene, TEFLON, DELRIN, oil filled NYLON, NYLON, or any other tough, low-friction, non-stick, non-abrasive, food-grade material.

It will be understood that the above-described benefits of the present invention apply to any dry ice forming apparatus, including block presses and the like, and are not limited only to pelletizers.

Accordingly, it is an object of the present invention to provide an improved method of forming dry ice.

It is another object of the present invention to provide an improved pelletizing system having the above improvements.

These and other objects, features and advantages of the present invention will become more apparent upon reading the following specification in conjunction with the accompanying drawing figures.

DETAILED DESCRIPTION OF A PREFERRED EMBODIMENT

Figure 1:
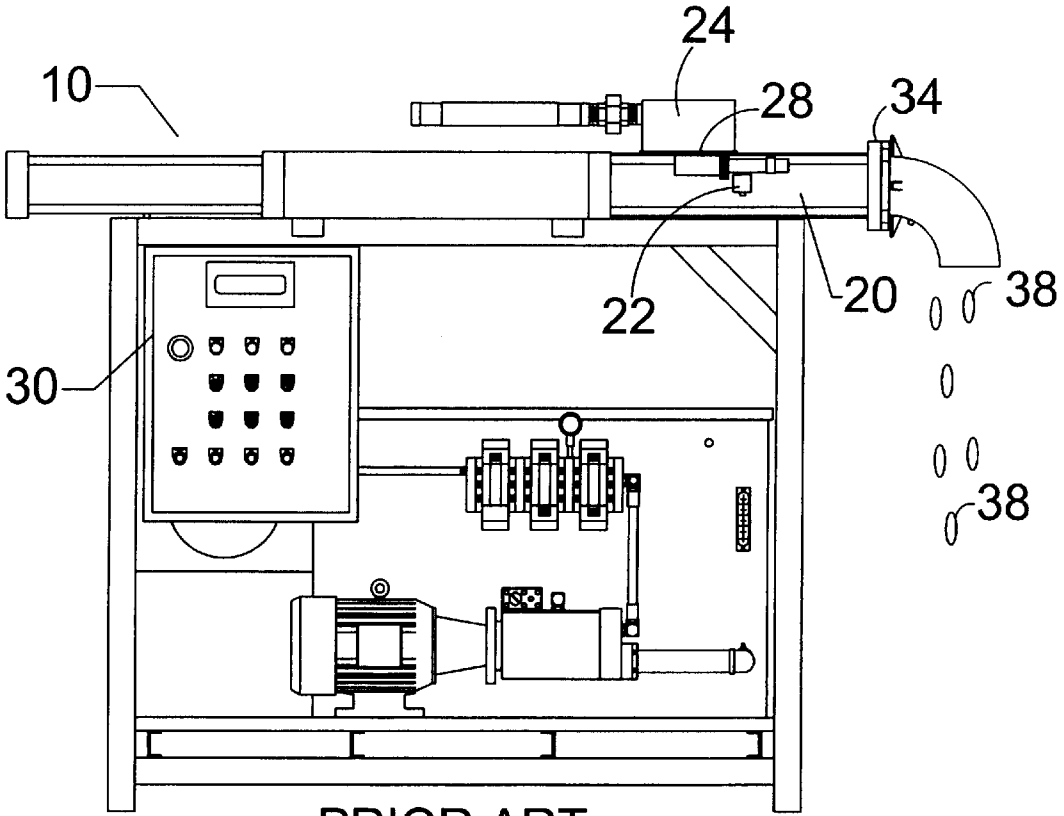
PRIOR ART FIG. 1
FIG. 1 illustrates a front view of a prior art pelletizer.
Figure 2:
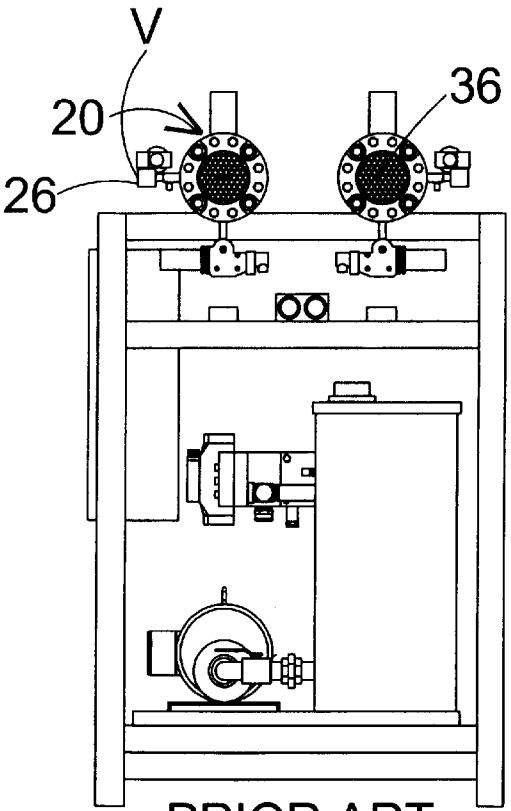
PRIOR ART FIG. 2
FIG. 2 is a side view of FIG. 1.

Referring to the drawings of the present application, the present invention provides numerous improvements upon conventional pelletizers, as representatively shown in FIGS. 1 and 2. A conventional pelletizer 10 is shown comprising a snow chamber 20 having an injection port 22 and a venting port 24. An injection nozzle 26 is located at the injection port 22 through which liquid $CO_2$ is introduced into the snow chamber 20. The pelletizer 10 further comprises a piston (not shown) operable within the snow chamber 20 on dry ice snow that is obtained from the liquid $CO_2$ delivered from a low pressure storage tank (not shown) through a metering valve V controlled by programmable controller 30.

The liquid $CO_2$ injected into the chamber 20 turns to portions of solid and gaseous $CO_2$. A majority of the resultant $CO_2$ vapors in the chamber 20 are pressure exhausted through a filter screen 28 over the venting port 24 into the atmosphere or directed to a compressor (not shown) for reliquification. Upon completion of the injection process, the piston compresses the snow through a fixed die 34 which is a circular, thick steel plate having cylindrical openings 36 therein through which the compacted snow is forced and extruded to form pellets 38.

The present improved pelletizing system comprises an automated helical injection system, an automated start-up system, a chamber with greater filter screen ratio than provided by present pelletizers and a compressing mechanism. The automated helical injection system incorporates the use of compound angle injection, tapered injection nozzles and an automated injection subsystem.

Figure 3:
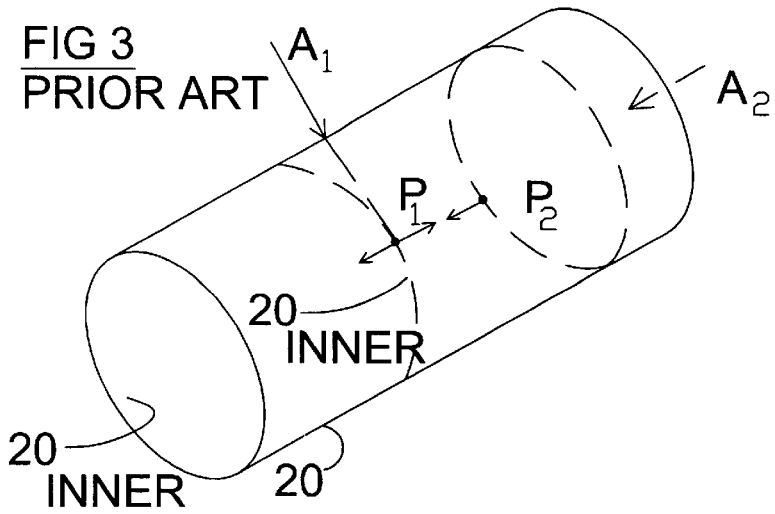
FIG 3 PRIOR ART
FIG. 3 is a perspective view of prior art injection.
Figure 4:
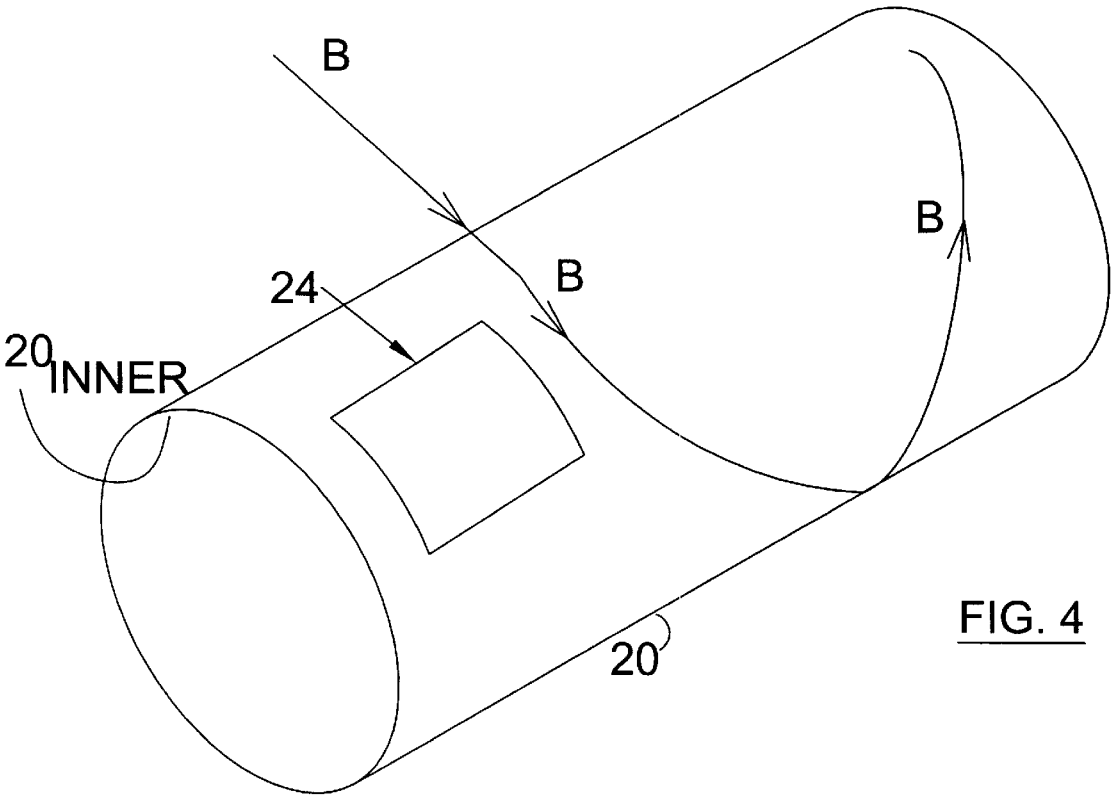
FIG. 4 is a perspective view of the helical injection of the present invention according to a preferred embodiment.

Referring now to FIGS. 3–12, the present pelletizing system improves on the conventional method of producing dry ice pellets by replacing currently used perpendicular and parallel injection schemes as shown in FIG. 3, with compound angle injection as illustrated in FIG. 4. The injection nozzle 26 of prior art pelletizers (FIGS. 1 and 2) injects the liquid $CO_2$ into the chamber 20 in direction $A_1$, being generally perpendicular to the length of chamber 20, or in direction $A_2$, being generally parallel to the length of chamber 20. The $CO_2$ flows through the core of the chamber 20 and collides into the inner wall $\mathbf{20}_{inner}$ of the other side of the chamber 20 approximately normal to the inner wall $\mathbf{20}_{inner}$. FIG. 3 shows the perpendicular stream of $CO_2$ striking point $P_1$ on the inner wall $\mathbf{20}_{inner}$ of the chamber, and then splitting toward both ends of the chamber 20. FIG. 3 also illustrates the parallel stream of $CO_2$ striking point $P_2$ on the inner wall $\mathbf{20}_{inner}$ of the chamber, and then sliding forward toward the die end of the chamber. The parallel stream flows at an angle downward into the chamber, and strikes $P_2$ on the floor of the chamber. Both streams shown in FIG. 3 are for example purposes only.

The compound angle injection of the present system enables the gaseous and solid $CO_2$ to follow a helical path B inside the extrusion chamber 20, as shown in FIG. 4. In defining such a path, the solid $CO_2$ is forced to the inner wall $\mathbf{20}_{inner}$ of the chamber 20. The ice slides along path B and against the inner wall $\mathbf{20}_{inner}$ of the extrusion chamber 20, the sliding friction causing the snow to pack more densely, and enabling the vapor to exit along the central axis of the extrusion chamber 20. This compound angle injection arrangement allows the solid $CO_2$ to pack uniformly away from the exhaust port 24, and toward the die end, therefore allowing more solid $CO_2$ into a given volume.

The helical path B in FIG. 4 is of a representative space curve path, and is not shown in any particular scale, or any particular torsion or curvature. It will be understood that path B will be altered by numerous factors including imperfections in the inner wall $\mathbf{20}_{inner}$ and the velocity of the entering $CO_2$ stream, among others. Path B may be more broadly defined as one that is not perpendicular to the radial centerline of the chamber, but that has at least some helical-like path being a compound angle that enables a majority of the injected stream to flow toward the exhaust 24, preferably a substantial majority of the stream.

Figure 5:
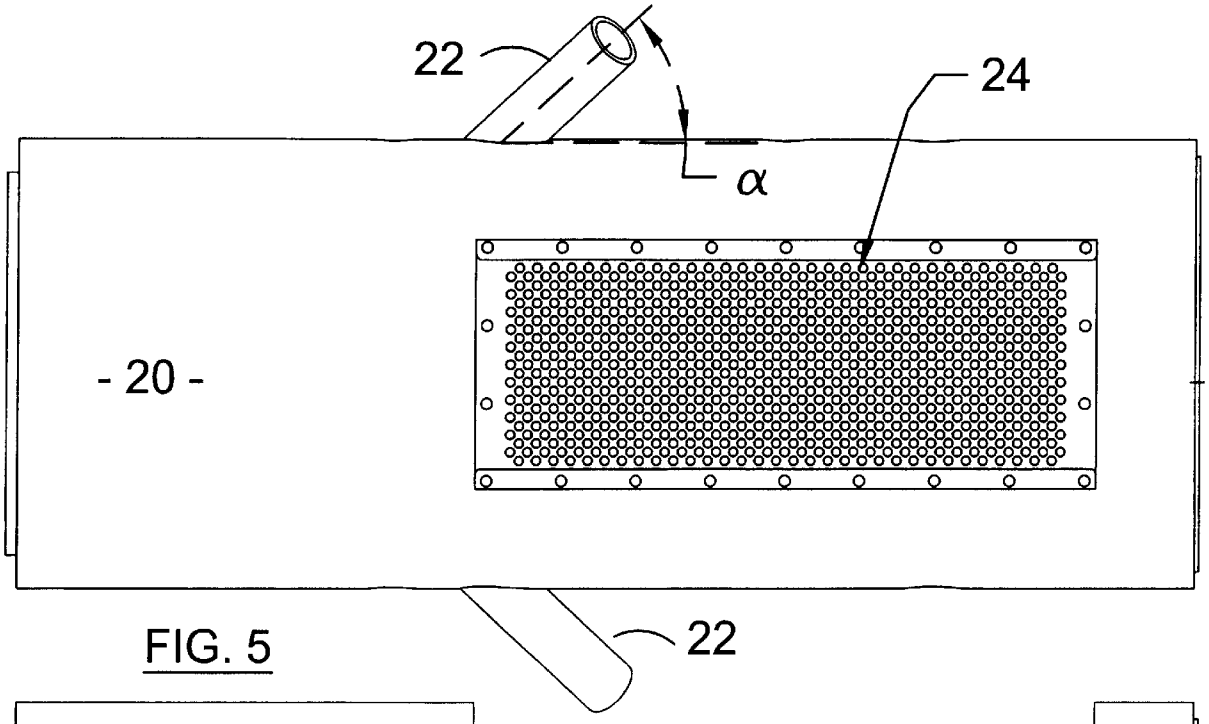
FIG. 5 is a side view of the chamber of the present invention having two injection nozzles at a compound angle to the extrusion chamber.
Figure 6:
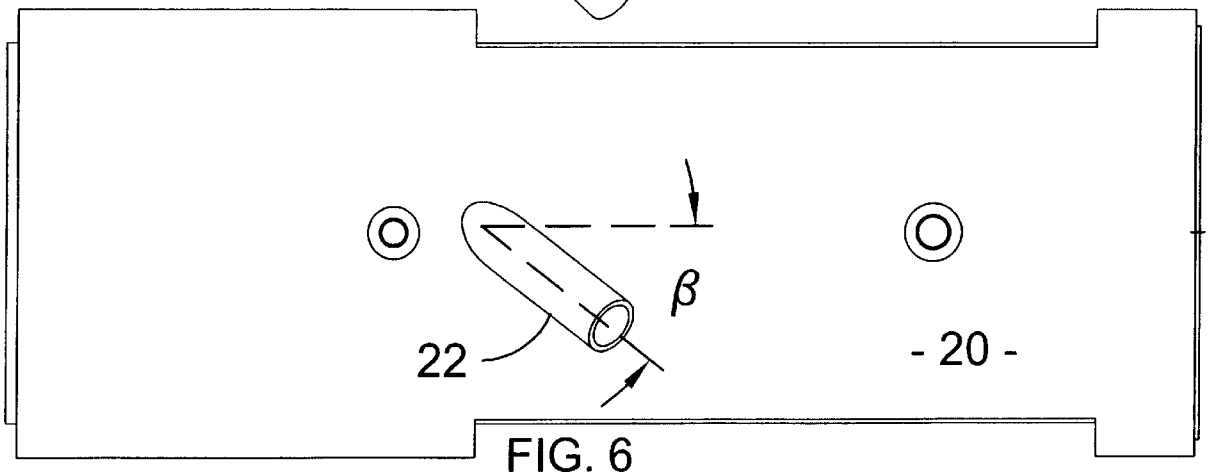
FIG. 6 is a top view of FIG. 5.

FIGS. 5 and 6 illustrate a representative example of an injection device being capable of directing the injected $CO_2$ in a helical-like path inside the snow chamber, that being angled injection nozzles 22. It will be understood that an injection device of the present invention can include other types of injection devices that impart such a helical-like path to the injected $CO_2$, for example, an injection device that has a bore being at a compound angle, or a momentum change device that imparts such angled injection.

FIGS. 5 and 6 illustrate the compound angle injection in reference to angles $\alpha$ and $\beta$. FIG. 5 defines angle $\alpha$ as an angle in the vertical plane of bisection of the chamber 20 away from the horizontal plane of bisection of the chamber 20. FIG. 6 defines angle $\beta$ as an angle in the horizontal plane of bisection of the chamber 20 away from the vertical plane of bisection of the chamber 20. While the angles may vary, the range of preferable compound angles for the injected stream are from 5° to 180° for both angles $\alpha$ and $\beta$, and more particularly 50° for angle $\alpha$, and 40° for angle $\beta$.

The present compound angle injection provides both more available volume of the chamber 20 to be used and better vapor removal that both equate to a higher injection rate. Some prior art injection nozzles 26 are situated perpendicular to the centerline of the chamber 20 without any compound angle, as shown in FIGS. 1–3. Under such prior art injection conditions, nearly equal amounts of solid $CO_2$ flow toward the ends of the chamber 20, causing the exhaust vent 24 to prematurely block with solid $CO_2$. Compound angle injection of the present invention aids both in starting the pelletizer, as well as facilitating the formation of a dry ice plug in the die end of the extrusion chamber. The present compound angle injection helps cool the die end the chamber faster than is possible by conventional pelletizers. The injected $CO_2$ is directed to the die end of the chamber, thus the die end is cooled quickly, instead of prior art designs that inject the $CO_2$ throughout the chamber, which wastes the cooling effect of the stream as it frosts the entire chamber, not initially the die end where the plug will form.

Figure 7:
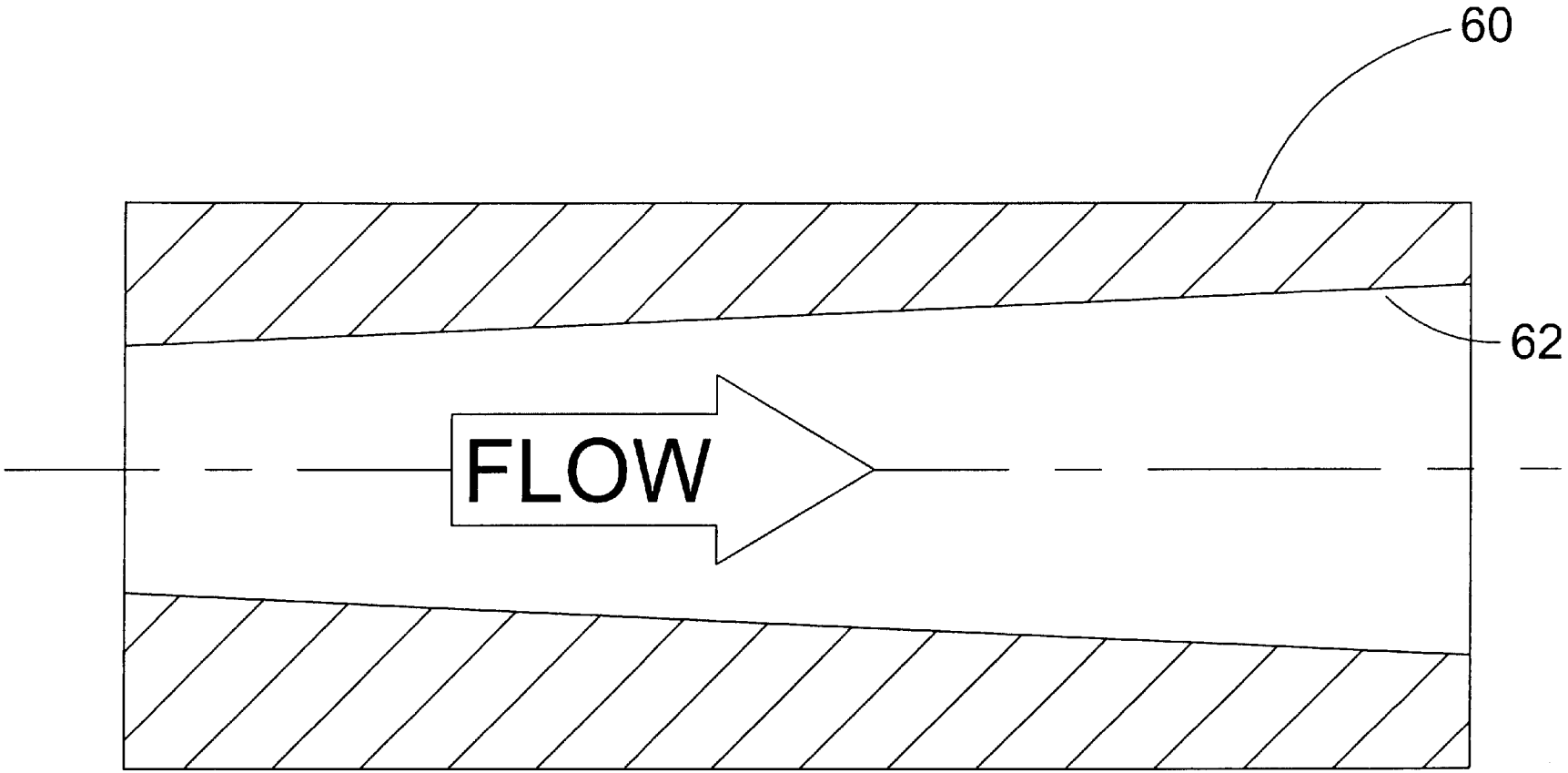
FIG. 7 is a cross-sectional view of a preferred injection nozzle of the present invention.

The present invention further comprises tapered injection nozzles 60, as illustrated in FIG. 7, wherein the channel 62 inside the nozzles 60 diverges in the direction from the metering valve (not shown) to the extrusion chamber (not shown). Older designs that use straight (non-tapered) pipe from the metering valve to the extrusion chamber frequently block completely, stopping production. Another effect of straight (non-tapered) pipe also is the random pressure variation inside the chamber that causes the operator to frequently adjust the metering valve.

The present system with tapered injection nozzles 60 enables the extrusion chamber pressure during injection to climb steadily from the start of the injection to the end, without the random pressure variation indicative of a straight (non-tapered) nozzle that is perpendicular to the chamber.

Figure 8:
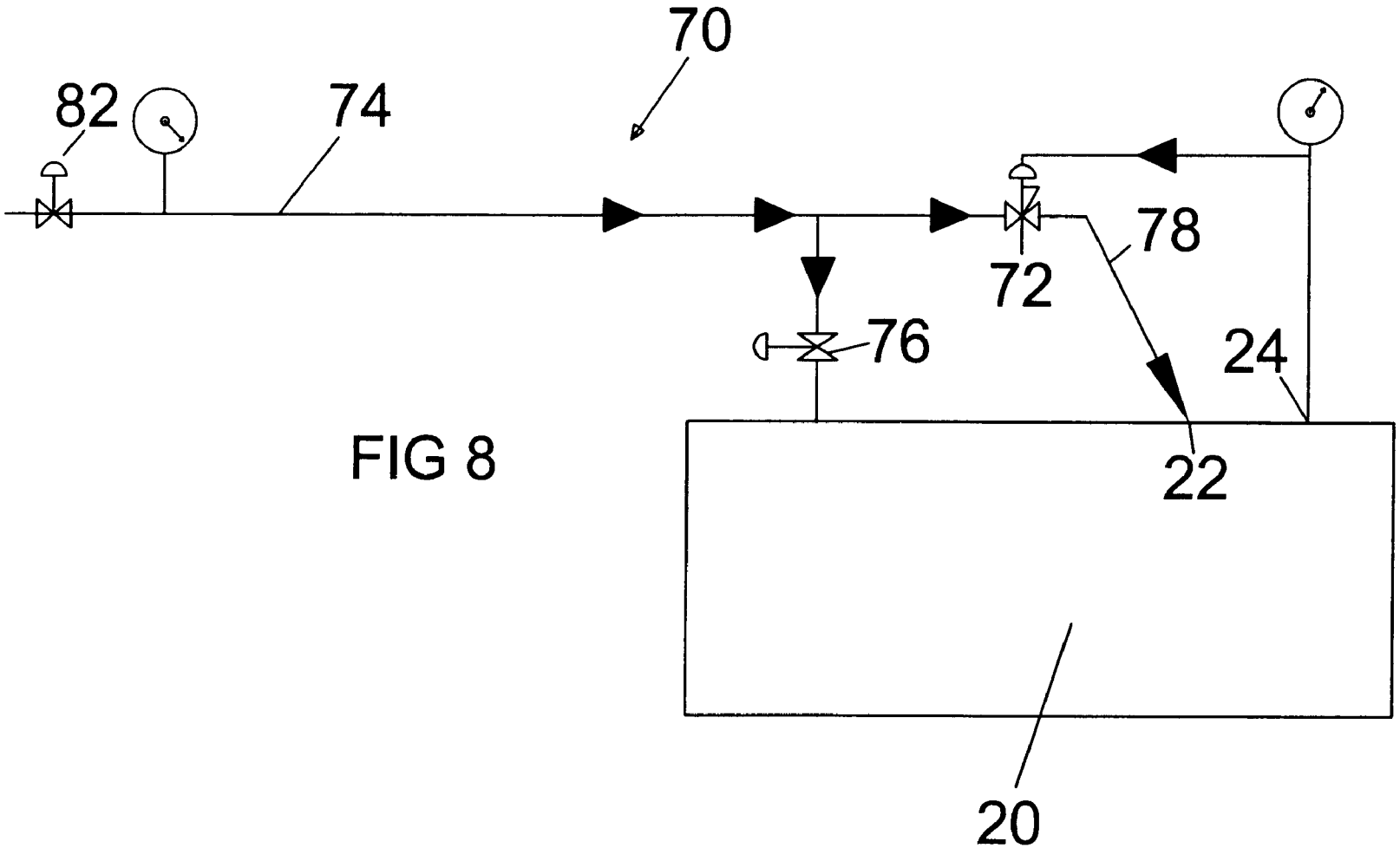
FIG. 8 illustrates a schematic of the automated injection system and automated start-up of the present invention.

As shown in FIGS. 5, 6 and 8, the pelletizing system further comprises an automated injection subsystem 70 including at least two injection ports 22 for injection of liquid $CO_2$ into the chamber, staggered injection rate capability and a valve arrangement. The at least two injection ports 22 enable the automated injection subsystem to provide staggered injection rates that, in turn, enable the greatest amount of solid $CO_2$ into the extrusion chamber 20 in the least amount of time. The valves 72 (FIG. 8) of the valve arrangement are adjustable to various flow rates and, as the pressure increases inside the chamber 20, the valves 72 are closed in order from highest flow rate to lowest. This arrangement allows the pressure inside of the extrusion chamber 20 to stay at a high pressure throughout injection but below the triple point for most of the injection cycle. This, coupled with the compound angle injection, allows for more solid $CO_2$ to be injected in a shorter time, dramatically increasing production of the present pelletizing system as compared with conventional designs.

A flow diagram of the automated injection subsystem 70 is shown in FIG. 8, illustrating a single injection port 22, as the additional injection port(s) 22 operate in a similar fashion. The subsystem 70 is provided with a controlled process valve 72 for each injection port that enables the injection of liquid $CO_2$ to be completely automated. The controlled process valve 72 eliminates the conventional manual labor necessary to adjust the metering valves V (FIGS. 2) of known machines by automating this procedure.

As shown, when the pelletizer of the present invention is operating post start-up, liquid $CO_2$ flows through supply line 74 to control valve 72, as start-up valve 76 is closed. The $CO_2$ stream flows through the control valve 72, and into the chamber 20 via injection line 16 78 through injection port 22. Pressure within the chamber 20 can be relieved through vent port 24.

Current designs have a manually controlled metering valve V that must be constantly adjusted to compensate for a variety of variables, including clogging of filter screens and changes in liquid pressure. Certain high volume dry ice production facilities have many machines producing tons of ice per day. Each one of these machines has at least one of these metering valves V, and each one of these valves V must be adjusted several times per day. Labor cost to monitor and adjust these metering valves is very high. The controlled process valve 72 monitors the pressure in the extrusion chamber 20, and opens or closes in a throttling process to regulate the pressure in the chamber 20 around a predetermined setpoint. The valve 72 thus automatically compensates for clogged filter screens, low liquid $CO_2$ pressure, and other conditions that would decrease the production in a pellet machine with a manual metering valve V. Preferably, a normally closed liquid $CO_2$ inlet valve 82 should be in place as a fail-safe, because controlled process valves 72 may not fail safely.

The present improved pelletizing system further incorporates an automated start-up procedure comprising a start-up valve 76 to fill the chamber 20 without blowing snow out of the chamber 20. Valve 76 preferably is located in the back of the chamber 20, as shown in FIG. 8. The start-up procedure is capable of forming an ice plug in the chamber 20, wherein the pelletizer can then begin to make ice. Liquid $CO_2$ is injected into chamber 20 through the start-up valve 76 until a preset start-up pressure is reached. The start-up injection valve is then closed, and the compressing mechanism (not shown) provides one cycle of compressing the $CO_2$ snow toward the front (die end) of the chamber 20. One cycle of the compressing mechanism can comprise a piston beginning at a start position, extending down the length of the chamber, passing the vent, until an end position, and finally returning to the start position. The start-up injection valve 76 would once again open and stay open until the start-up pressure again is reached, and the snow again compressed. The automated start-up procedure includes the repeated use of this cycle until a preset chamber pressure is met, indicating that an ice plug has formed and the pelletizer has begun making ice.

Figure 9:
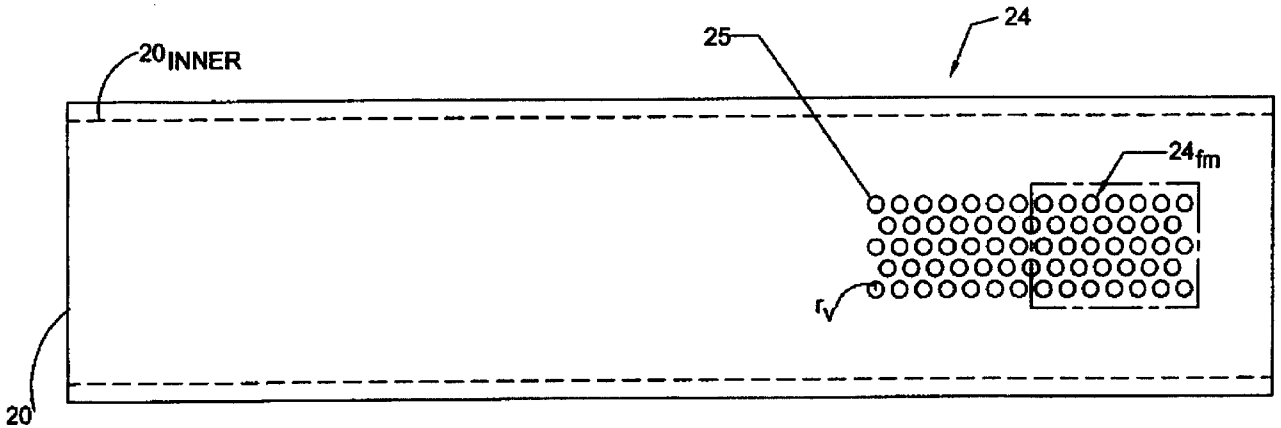
FIG. 9 shows the extrusion chamber of the present invention having a filter screen ratio of greater than 35%.

The extrusion chamber 20 of the improved pelletizer of the present invention incorporates a 35% or greater filter screen ratio ($FS_{ratio}$) as shown in FIG. 9. Filter area is very important to the production of dry ice. There is a minimum ratio of the filter screen area to the bore area of 35% for high production. Any ratio less than this minimum ratio decreases production of ice. The higher the ratio is, the greater the benefit. Filter screen ratio is defined as follows:

$$FS_{ratio}=V_{area}/C_{area} \quad (1)$$

wherein $V_{area}$ is the vent area, and $C_{area}$ is the chamber area.

Figure 10:
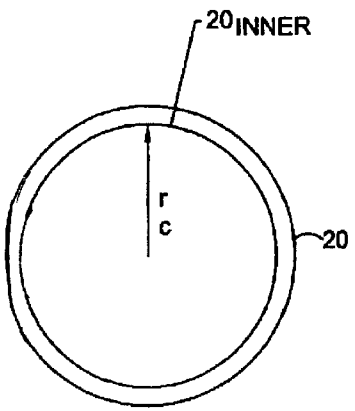
FIG. 10 is a cross-sectional view of the chamber of FIG. 9

As shown in FIGS. 9 and 10, the vent area is the accumulated area of each vent hole 25. Alternatively, the vent area can be the area of a single continuous aperture in chamber 20, as the vent port 24 is shown in FIG. 4. FIG. 9 illustrates numerous vent holes 25 of equal area, and therefore the vent area equals:

$$V_{area}=(\pi r_v^2)(\text{number of vent holes}) \quad (2)$$

The chamber area is the average chamber cross-sectional area. For a chamber 20 of uniform diameter as shown in FIGS. 9 and 10, the chamber area equals:

$$C_{area}=(\pi r_c^2) \quad (3)$$

In this example, the filter screen ration would be:

$$FS_{ratio}=V_{area}/C_{area}=(r_v^2)(\text{number of vent holes})/(r_c^2) \quad (4)$$

The present chamber 20 further includes filter media $\mathbf{24}_{fm}$, shown in phantom lines in FIG. 9, placed over or under one or more of the venting ports in order to maximize the vapor exhaust rate of $CO_2$ from the chamber 20. Filter media $\mathbf{24}_{fm}$ over the venting ports allow such a rapid exhaust rate without traditional concerns including the loss of snow into the exhaust piping.

Figure 12:
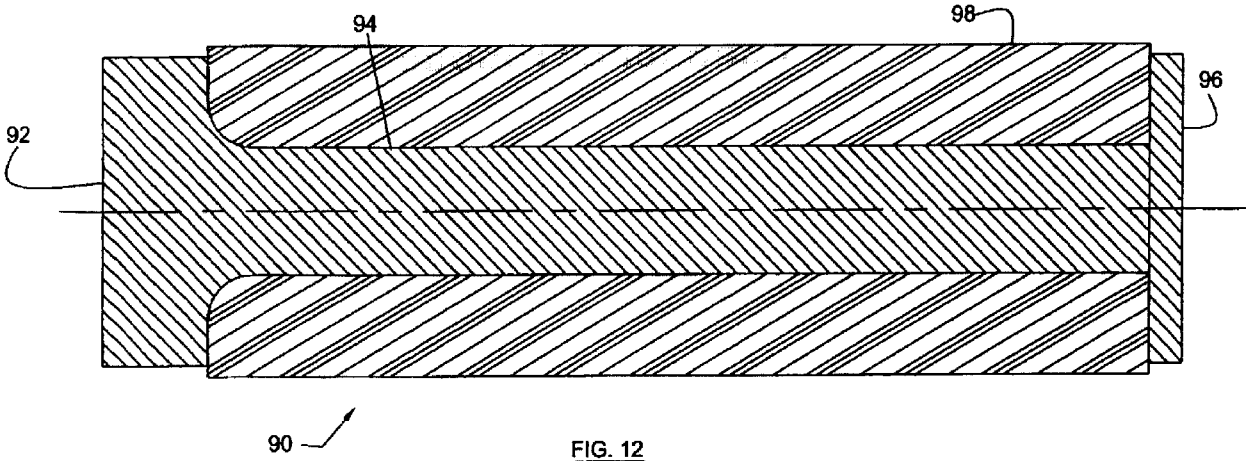
FIG. 12 is another cross-sectional view of the compressing mechanism of the present invention according to another preferred embodiment.
Figure 11:
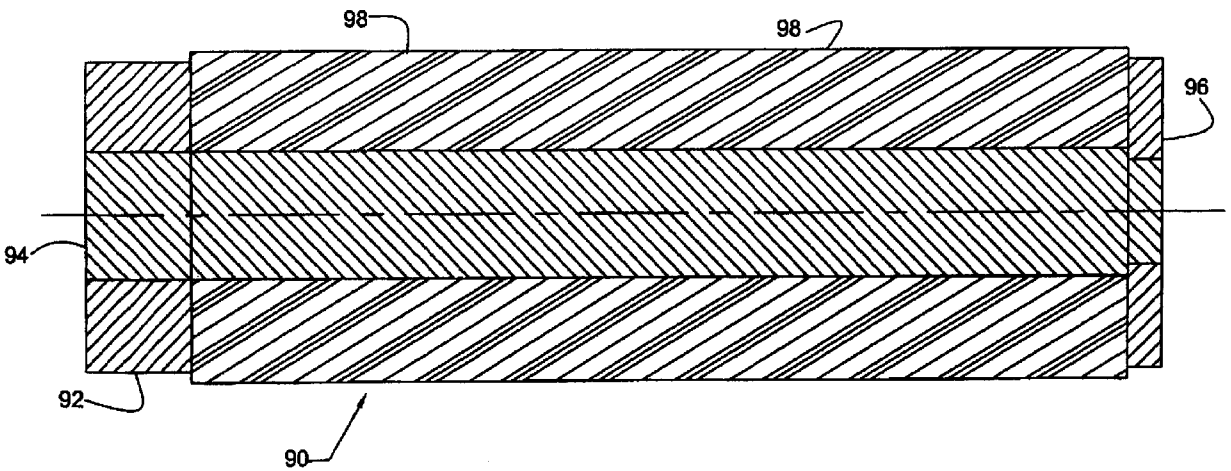
FIG. 11 is a cross-sectional view of the compressing mechanism of the present invention according to a preferred embodiment.

The present system can further comprise a compressing mechanism 90 including a full-size piston 92 as shown in FIGS. 11 and 12, which is a novel type of piston for dry ice pellet machines. The compressing mechanism 90 of the present system includes a rod 94 and the piston 92 capable of travel within the chamber 20. The compressing mechanism preferably comprises a solid metal rod 94, piston 92, sleeve retainer 96, and sleeve 98 made of UHMW polyethylene, Teflon, Delrin, oil filled Nylon, Nylon, or any other tough, low-friction, non-stick, non-abrasive, food-grade material. The entire mechanism can be an assembly of sub-components (FIG. 11) or made in one piece (FIG. 12).

Although the Figs. represent a chamber 20 mainly having a uniform chamber cross-sectional area along the length of the chamber 20, the inside of the chamber need not be so uniform. The chamber cross-sectional area may uniformly taper toward one end of the chamber, or may vacillate between the ends of the chamber.

It should be understood by those of ordinary skill in the art that the improvements of the present pelletizing system have a synergistic effect. Using only one improvement may cause a small increase in production, but using more than one improvement will result in a production increase greater than each improvement taken individually. These improvements allow the liquid $CO_2$ injection portion of the cycle to take less time than a machine without these improvements, increasing production.

While the invention has been disclosed in its preferred forms, it will be apparent to those skilled in the art that many modifications, additions, and deletions can be made therein without departing from the spirit and scope of the invention and its equivalents, as set forth in the following claims.

What is claimed is:

1. In a dry ice system capable of producing dry ice from $CO_2$ snow, the dry ice system including: (i) a snow chamber having an injection port; (ii) an injection device through which $CO_2$ can be introduced into the snow chamber through the injection port; and a compressing mechanism capable of compressing the $CO_2$ snow in the snow chamber, an improvement to the dry ice system comprising a helical injection system capable of imparting the injected $CO_2$ with a helical path inside the snow chamber.

2. The improved dry ice system of claim 1, the helical injection system comprising a compound angle injection nozzle.

3. In a dry ice system capable of producing dry ice from $CO_2$ snow, the dry ice system including: (i) a snow chamber having an injection port; (ii) an injection device through which $CO_2$ can be introduced into the snow chamber through the injection port; and (iii) a compressing mechanism capable of compressing the $CO_2$ snow in the snow chamber, an improvement to the dry ice system comprising a tapered injection nozzle, the nozzle being the injection device and having a diverging bore in the direction of flow of the $CO_2$ through the nozzle.

4. The improved dry ice system of claim 3, wherein the tapered nozzle is capable of directing the injected $CO_2$ in a helical path inside the snow chamber.

5. In a dry ice system capable of producing dry ice from $CO_2$ snow, the dry ice system including: (i) a snow chamber having an injection port; (ii) an injection device through which $CO_2$ can be introduced into the snow chamber through the injection port; and (iii) a compressing mechanism capable of compressing the $CO_2$ snow in the snow chamber, an improvement to the dry ice system comprising at least two injection devices, a first and a second injection device, and an automated injection subsystem being capable of staggering the injection rate of $CO_2$ into the snow chamber by first enabling the injection of $CO_2$ into the chamber through the first injection device at a first injection rate until a first pressure is met at which time injection through the first injection device is halted, and then by second enabling the injection of $CO_2$ into the chamber through the second injection device at a second injection rate until a second pressure is met at which time injection through the second injection device is halted, wherein the first injection rate is higher than the second injection rate.

6. In a dry ice system capable of producing dry ice from $CO_2$ snow, the dry ice system including: (i) a snow chamber having an injection port; (ii) an injection device through which $CO_2$ can be introduced into the snow chamber through the injection port; and (iii) a compressing mechanism capable of compressing the $CO_2$ snow in the snow chamber, an improvement to the dry ice system comprising an automated start-up subsystem being capable of forming an ice plug in the chamber prior to production of dry ice.

7. The improved dry ice system of claim 6, the automated start-up subsystem comprising a start-up valve capable of filling the chamber with $CO_2$.

8. In a dry ice system capable of producing dry ice from $CO_2$ snow, the dry ice system including: (i) a snow chamber having an injection port; (ii) an injection device through which $CO_2$ can be introduced into the snow chamber through the injection port; and (iii) a compressing mechanism capable of compressing the $CO_2$ snow in the snow chamber, an improvement to the dry ice system comprising a vent through which $CO_2$ can escape the chamber, the area of the vent being at least 35% of the average cross-sectional area of the snow chamber.

9. In a dry ice system capable of producing dry ice from $CO_2$ snow, the dry ice system including: (i) a snow chamber having an injection port; (ii) an injection device through which $CO_2$ can be introduced into the snow chamber through the injection port; and (iii) a compressing mechanism capable of compressing the $CO_2$ snow in the snow chamber, an improvement to the dry ice system comprising the compressing mechanism including a piston having a low-friction sleeve.

10. In a pelletizing system capable of producing dry ice pellets from $CO_2$ snow, the pelletizing system including: (i) a snow chamber having an inner surface, at least two injection ports and at least one venting port; (ii) an injection nozzle at each injection port through which liquid $CO_2$ can be introduced into the snow chamber; and (iii) a compressing mechanism capable of compressing the $CO_2$ snow in the snow chamber, improvements to the pelletizing system comprising:

(a) compound angle injection nozzles capable of helically directing the injected $CO_2$ into the chamber, the nozzles being tapered in the direction of flow of the $CO_2$ through the nozzle; and (b) an automated injection subsystem capable of adjusting the flow rates through the nozzles such that they are staggered.

11. The improved pelletizing subsystem of claim 10, the injection nozzles being capable of directing the injected $CO_2$ at an angle in the horizontal plane of bisection of the chamber of between approximately 5° to 180° from the vertical plane of bisection of the chamber.

12. The improved pelletizing subsystem of claim 11, the injection nozzles being capable of directing the injected $CO_2$ at an angle in the horizontal plane of bisection of the chamber of approximately 50° from the vertical plane of bisection of the chamber.

13. The improved pelletizing subsystem of claim 10, the injection nozzles being capable of directing the injected $CO_2$ at an angle in the vertical plane of bisection of the chamber of between approximately 5° to 180° from the horizontal plane of bisection of the chamber.

14. The improved pelletizing subsystem of claim 13, the injection nozzles being capable of directing the injected at an angle in the vertical plane of bisection of the chamber of approximately 40° from the horizontal plane of bisection of the chamber.

15. The improved pelletizing system of claim 10, further comprising an automated start-up subsystem being capable of forming a ice plug in the chamber prior to production of dry ice pellets.

16. The improved pelletizing system of claim 15, the automated start-up subsystem comprising a start-up valve capable of filling a portion of the chamber with $CO_2$, the start-up valve and the compressing mechanism operating together to form an ice plug.

17. The improved pelletizing system of claim 10, the area of the venting port being at least 35% of the average cross-sectional area of the snow chamber.

18. In a pelletizing system capable of producing dry ice pellets from $CO_2$ snow, the pelletizing system including the following steps: (i) injecting $CO_2$ into a snow chamber through an injection port and (ii) compressing the $CO_2$ snow in the snow chamber, an improvement to the pelletizing system comprising the step of directing the injected $CO_2$ in a helical-like path inside the snow chamber.

19. The improved pelletizing system of claim 18, the step of directing the injected $CO_2$ in a helical-like path inside the snow chamber being provided by a compound angle injection nozzle.

20. In a pelletizing system capable of producing dry ice pellets from $CO_2$ snow, the pelletizing system including the following steps: (i) injecting $CO_2$ into a snow chamber through an injection port and (ii) compressing the $CO_2$ snow in the snow chamber, an improvement to the pelletizing system comprising injecting the $CO_2$ into the snow chamber through a tapered injection nozzle, the nozzle having a diverging bore in the direction of flow of the $CO_2$ through the nozzle.

21. In a pelletizing system capable of producing dry ice pellets from $CO_2$ snow, the pelletizing system including the following steps: (i) injecting $CO_2$ into a snow chamber through an injection port and (ii) compressing the $CO_2$ snow in the snow chamber, an improvement to the pelletizing system comprising injecting $CO_2$ into the snow chamber at staggered injection rates through at least two injection ports.

22. In a pelletizing system capable of producing dry ice pellets from $CO_2$ snow, the pelletizing system including the following steps: (i) injecting $CO_2$ into a snow chamber through an injection port and (ii) compressing the $CO_2$ snow in the snow chamber, an improvement to the pelletizing system comprising the step of controlling the flow of injected $CO_2$ through at least two injection ports by inhibiting flow through the at least two injection ports in order from highest flow rate to lowest flow rate.

23. In a pelletizing system capable of producing dry ice pellets from $CO_2$ snow, the pelletizing system including the following steps: (i) injecting $CO_2$ into a snow chamber through an injection port and (ii) compressing the $CO_2$ snow in the snow chamber, an improvement to the pelletizing system comprising venting pressure from the chamber through a vent port, the area of the vent port being at least 35% of the average cross-sectional area of the snow chamber.

* * * * *